US005553807A

United States Patent [19]

Lopez

[11] Patent Number: 5,553,807

[45] Date of Patent: Sep. 10, 1996

[54] FENCE INSTALLATION METHOD AND DEVICE

[76] Inventor: Enrique R. Lopez, 3411 S. Fruit, Fresno, Calif. 93706

[21] Appl. No.: 331,011

[22] Filed: Oct. 27, 1994

[51] Int. Cl.[6] ..... B65H 16/02

[52] U.S. Cl. ..... 242/557

[58] Field of Search ..... 242/557, 598, 242/598.3, 598.5

[56] References Cited

U.S. PATENT DOCUMENTS

| | | | |
|---|---|---|---|
| 3,048,348 | 8/1962 | Griffin | 242/598 |
| 3,070,946 | 1/1963 | Kirsh et al. | 242/557 |
| 4,930,718 | 6/1990 | Lancour et al. | 242/557 |
| 5,163,634 | 11/1992 | Moon et al. | 242/598.5 |
| 5,388,782 | 2/1995 | King | 242/557 |

*Primary Examiner*—John P. Darling
*Attorney, Agent, or Firm*—Mark D. Miller

[57] ABSTRACT

A method and device that allows for streamlined and efficient upright installation of coiled fence materials into fences. The device is an elongated hollow cylindrical drum designed to receive a coil of fence material which may be opened lengthwise according to a set of hinges down one side. A longitudinal gap is provided in the drum through which the leading edge of the coil of fence may pass. The underside of the drum opposite the opening is attached to a sturdy rotatable support pole. The opposite end of the support pole is designed for easy attachment to the lifting mechanism of a suitable machine (such as a tractor, backhoe, forklift or bulldozer).

Once the pole is attached to the lifting machine, and a coil of fence placed in the drum, it is closed and latched allowing the leading edge of the fence to extend through the gap in the drum. Using the machine, the method of installation begins with lifting the pole thereby lifting the drum up off the ground. Then the pole and drum are then rotated approximately ninety degrees (90°), bringing the drum to an upright position. The fence coil may then be unrolled as it sits in the drum for attachment to waiting fence posts.

7 Claims, 5 Drawing Sheets

FENCE INSTALLATION METHOD AND DEVICE

BACKGROUND OF THE INVENTION

The present invention relates to fences, and in particular to a new and highly efficient method and device for the easy upright installation and erection of coiled fences.

Many different kinds of fences are coiled into rolls after manufacturing. These rolls allow for convenient storage and shipment. Chain link and woven wire fabric fence are common examples of fences that are provided in coiled rolls. When a purchaser orders such a fence for installation, and the fence rolls are delivered to the installation site, it is a time consuming, difficult and labor-intensive task to erect the fence upright. This is especially true for taller fences (over 8 feet in height).

Present methods for upright installation of tall coiled fences can involve the use of at least 3 different laborers. The fence coil must be turned on its side, and held upright by at least one laborer. A second laborer stands at the base of the fence as it is unwound, attaching the lower section of the fence (as far as can be reached) to the fence posts. A third laborer stands on a ladder to attach the upper section of the fence (above the reach of the second laborer) to the fence posts. After attachment, the upright fence coil must be unrolled as it is moved to the next fence post for attachment. This alone is a difficult and cumbersome process which will necessarily involve several laborers.

The taller the fence, the wider the fence coil will be, and the more difficult the attachment and movement operations become. Thus, present methods of installing coiled fences involve considerable time, labor and expense.

SUMMARY OF THE INVENTION

The present invention overcomes many of the drawbacks presented by present methods of installing coiled fences, and provides a method and device that allows for streamlined and efficient upright fence installation. The device is an elongated hollow cylindrical drum that may be opened lengthwise according to a set of hinges down one side. The drum is designed to receive a coil of fence material. When the drum is closed, a longitudinal gap is provided through which the leading edge of the coil of fence may pass. The longitudinal underside of the drum opposite the opening is attached near the middle using reinforcement to a sturdy rotatable support pole. The opposite end of the support pole is designed for easy attachment to the lifting mechanism of any suitable machine (e.g. tractor, backhoe, forklift or bulldozer).

Once the pole is attached to the lifting machine, a coil of fence is placed in the drum and it is closed and latched. The leading edge of the fence is allowed to extend through the gap in the drum. Using the machine, the method of installation begins with lifting the pole thereby lifting the drum up off the ground. Then the pole is then rotated ninety degrees (90°), rotating the drum to an upright position. This may be done either by hand or using the machine. The machine then drives the elevated, rotated drum into the vicinity of the fence posts where the fence is to be attached. The fence coil is then unrolled as it sits in the drum and is immediately attached to the fence posts. The machine drives the drum from post to post for attachment until the coil runs out. Another coil of fence is then placed in the drum and the process repeated until completed.

It is therefore a primary object of the present invention to provide a device for easy upright installation of coiled fences.

It is a further important object of the present invention to provide a movable, closable drum for receiving and moving a coil of fence material into proper position.

It is a further important object of the present invention to provide a movable, partially closable drum for receiving a coil of fence material having a longitudinal hinged door along one side that provides a longitudinal opening when closed through which one end of a coil of fence material may pass for use in moving coiled fence material into position for erection and installation.

It is a further important object of the present invention to provide a movable, partially closable drum for receiving a coil of fence material to be erected into an upright fence, said drum being attached to one end of a rotatable support pole, the opposite end of the pole being adapted for mounting on a drivable lifting machine such as a tractor.

It is a further object of the present invention to provide a pole mounted closable drum for receiving and holding a coil of fence material which is attachable by a pole means to a drivable lifting machine for easy lifting and placement of the fence coil for upright installation.

It is a further object of the present invention to provide a method for upright installation of coiled fences using a pole mounted closeable drum attached to a drivable lifting machine.

It is a further object of the present invention to provide a method for moving coiled fence material into position for erection and upright installation using a pole mounted partially closeable drum attached to a drivable lifting machine.

It is a further object of the present invention to provide an easy, rapid, and inexpensive device and method for erecting coiled fences utilizing minimal manpower labor.

Additional objects of the invention will be apparent from the detailed descriptions and the claims herein.

DETAILED DESCRIPTION OF THE DRAWINGS

Figure 1:
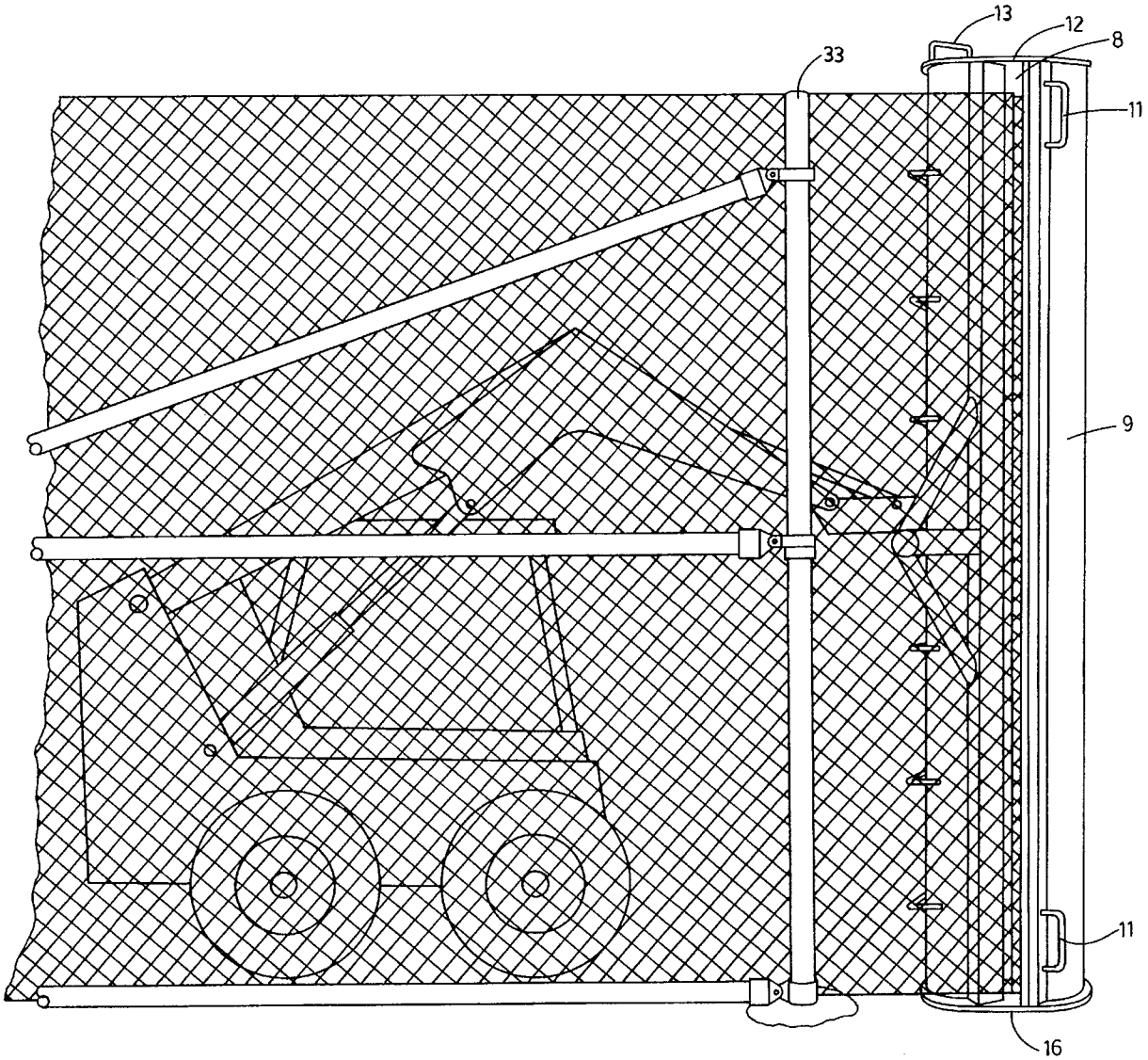
FIG. 1 is a side view of the present invention showing the drum thereof in a raised, rotated position with fence material passing through the gap thereof.
Figure 2:
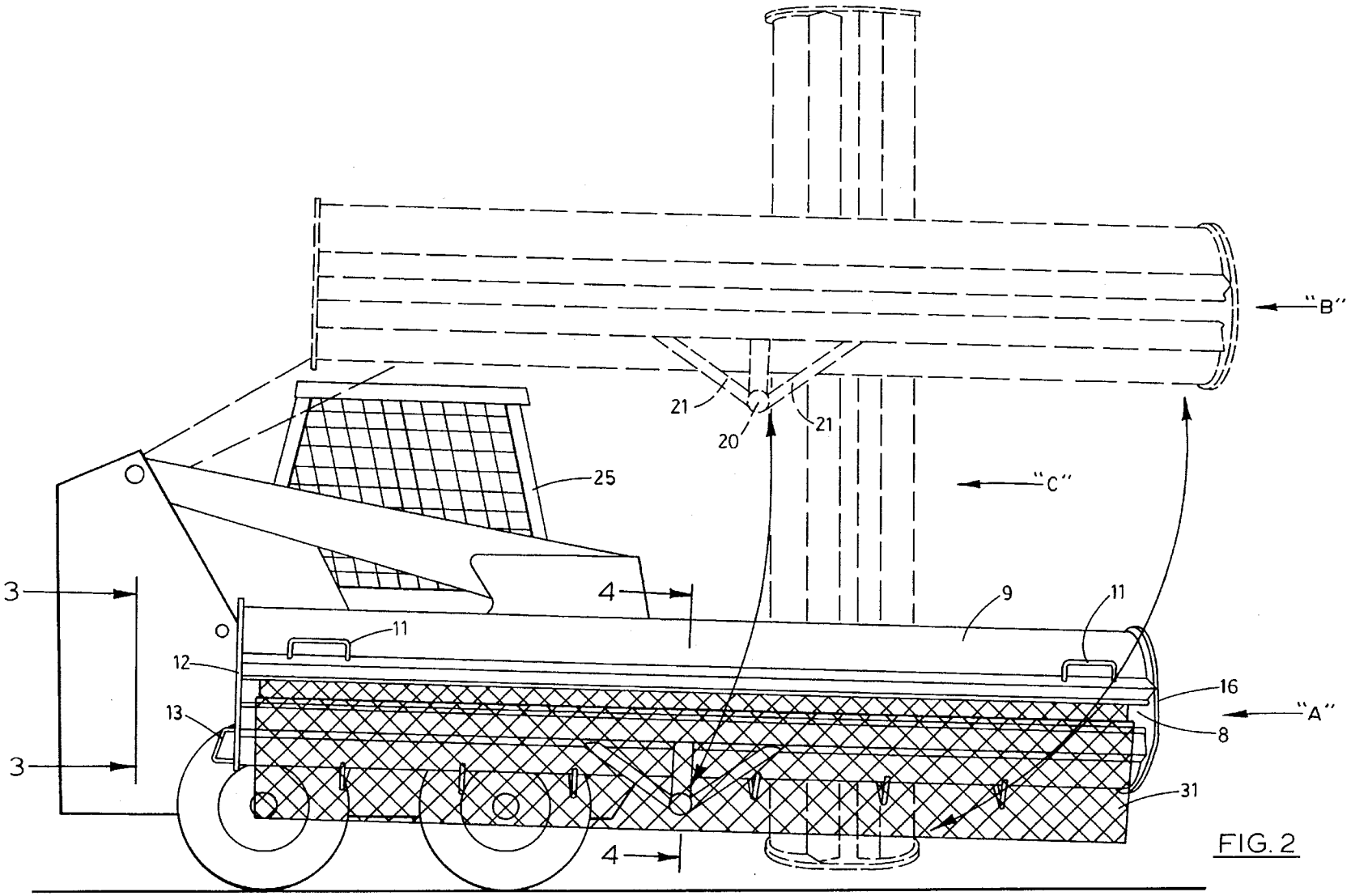
FIG. 2 is a different side view of the present invention showing the drum thereof in a lowered, un-rotated position. The first set of phantom lines (with arrows) show the first step of lifting the drum; the second set of phantom lines show the second set of rotating the drum upright 90 degrees.
Figure 3:
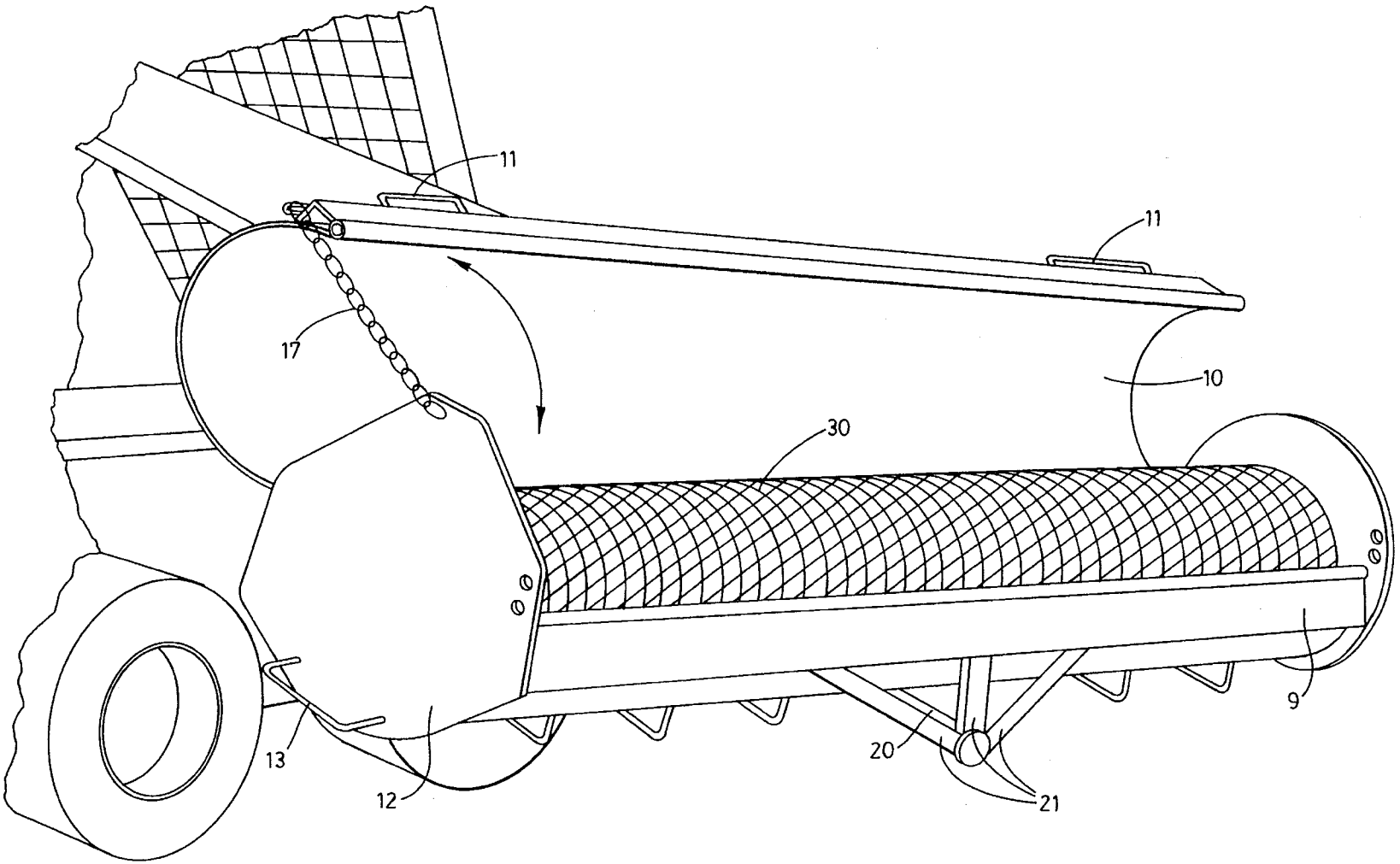
FIG. 3 is a a perspective end view of the drum of the present invention along line 3—3 of FIG. 2 showing the door thereof in an open position, revealing a coil of fence material inside.

Referring to the drawings wherein like reference characters designate like or corresponding parts throughout the several views, and referring particularly to FIGS. 1, 2 and 3 it is seen that the invention includes a hollow cylindrical drum 9 having a hinged door 10 attached longitudinally thereto. The door is attached by hinges 15 and is provided with handles 11. Additional handles 13 are provided at one end 12 of drum 9. A latch 14 is provided at the opposite end 16 of drum 9. Limiting means in the form of chains 17 are provided to prevent door 10 from opening too widely. A set of support feet 18 are also provided under drum 9 to prevent it from rolling during loading.

Figure 5:
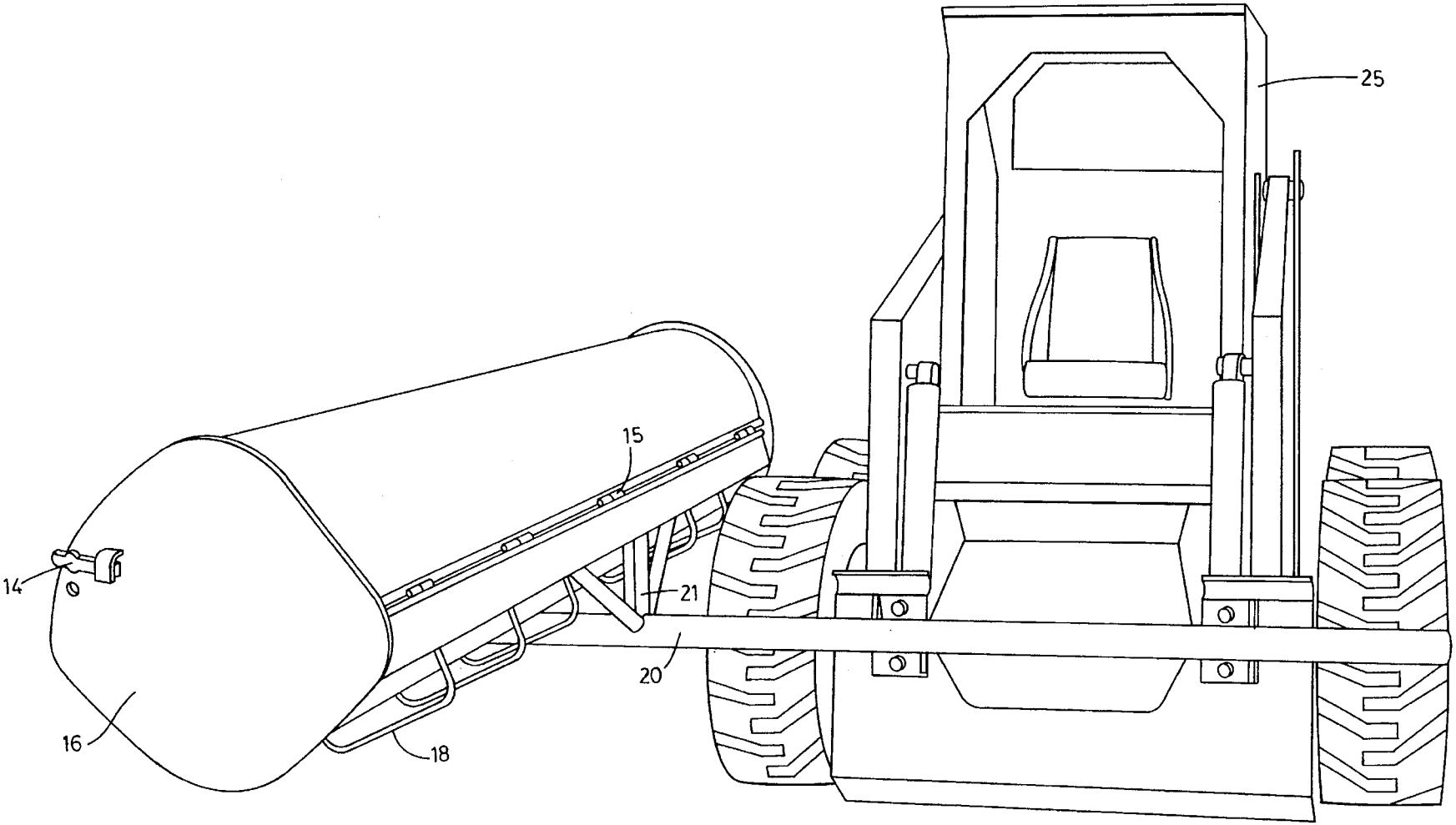
FIG. 5 is an opposite end perspective view of the present invention showing the support pole thereon and its attachment to a bulldozer tractor.

A support pole 20 is attached using reinforcement means 21 to the underside of drum 9 as shown in FIG. 3. The opposite end of pole 20 is available for attachment to a mechanical lifting machine 25 such as the bulldozer tractor shown in FIG. 5.

Figure 4:
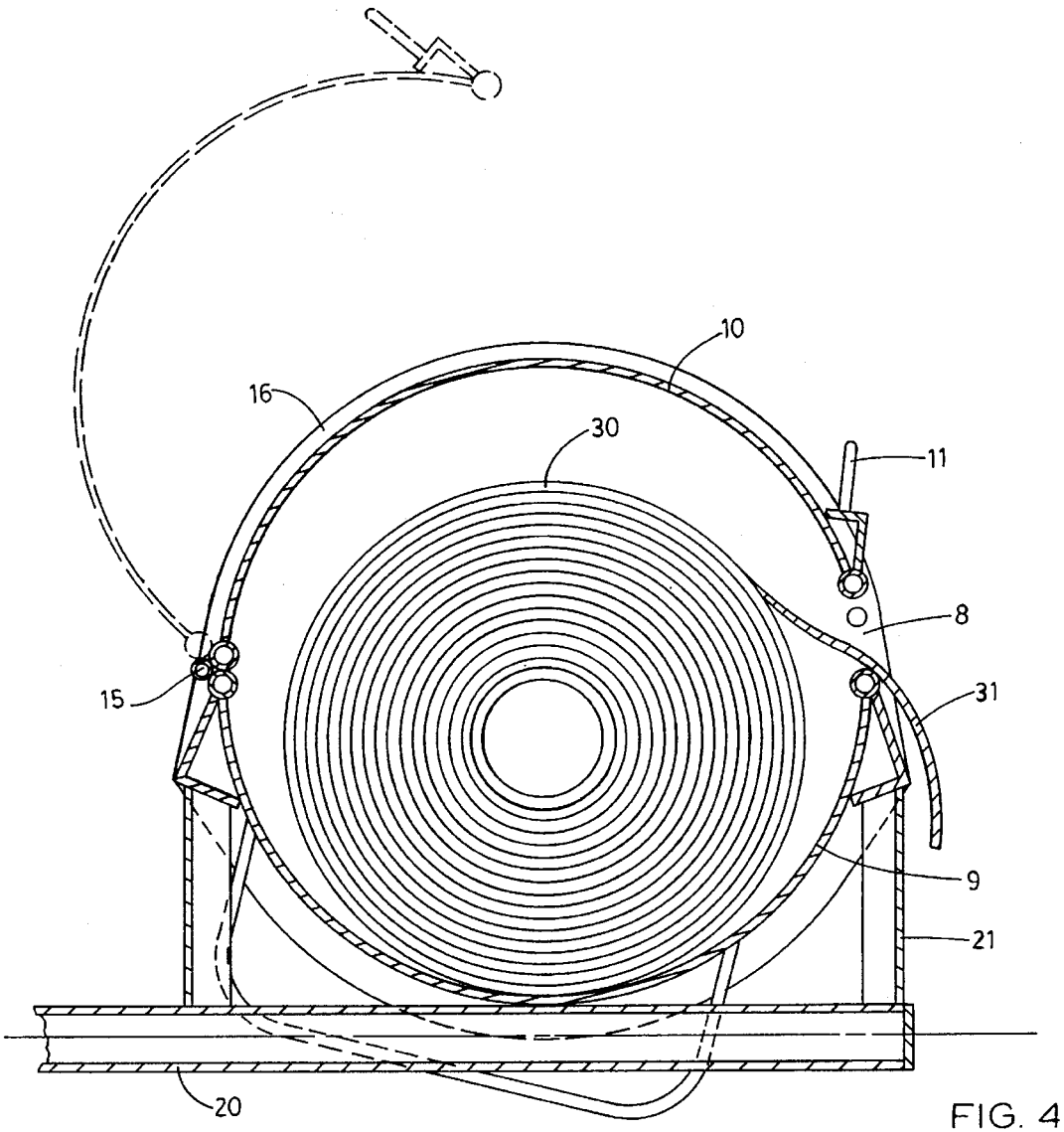
FIG. 4 is a cutaway view of the present invention along lines 4—4 of FIG. 2 showing the cross section of the fence coil and its leading edge passing through the gap in the drum. The phantom lines depict the alternative open position of the door.

A coil of fence material 30 may be placed in drum 9 as shown in FIG. 4. The leading edge 31 of coil 30 is allowed to drape through the opening 8 between the bottom of drum 9 and door 10. Once closed, latch 14 is engaged to prevent the coil 30 from falling out of drum 9 as it is lifted and rotated.

FIG. 2 illustrates the three positions of drum 9. The solid lines of FIG. 2 show the lowered rest position ("A") immediately after the fence coil 30 has been loaded, door 10 closed, and latch 14 secured. Leading edge 31 is allowed to drape through opening 8. The first set of phantom lines ("B") show drum 9 raised vertically before any rotation. The second set of phantom lines ("C") show drum 9 after it has been rotated 90 degrees on its end.

FIG. 1 then illustrates the removal of the fence material 30 from the drum, attachment to fence posts 33, and the support provided by the tractor machine with the present invention attached.

DESCRIPTION OF THE PREFERRED EMBODIMENTS

In the preferred embodiment, the drum 9 of the present invention is made of sturdy metal, although in some cases a rigid fiberglass or other suitable plastic material may be used. Door 10 should be made of the same material as drum 9. Pole 20 and support structures 21 should be made of sturdy metal in order to support the full load of a heavy coil of fence material. Pole 20 should be mounted near the middle of the underside of drum 9 in order to allow for easy and complete rotatability, once raised. Pole 20 should also be long enough to allow secure attachment to the bulldozer tractor or other lifting machine.

Gap 8 can be fairly wide in order to allow fence material with a thick cross section to pass through it. Latch 14 should be strong enough to support the leaning weight of the fence material inside.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A device for upright installation of coiled fence materials comprising a cylindrical drum adapted to receive a coil of fence material having a closable door along its length such that a gap is provided between said drum and said door when closed so that the leading edge of said coiled fence material may pass freely through said gap, said drum having no less than one rotatable support pole attached to the underside thereof for attachment to a mechanical lifting means, said drum being provided with a plurality of handles to assist in opening and rotating said drum.

2. The device described in claim 1 wherein a door limitation means and a closable latch are provided for said door.

3. In combination, a transportable lifting machine and a device for erecting chain link fences, said device comprising an elongated drum adapted to receive a coil of fence material, said drum having a closable door thereon through which the leading edge of said coil of fence material may pass when the door is closed, the underside of said drum attached to one end of at least one rotatable support pole, and the opposite end of said pole being removably attached to said transportable lifting machine, said drum being provided with a plurality of handles to assist in opening and rotating said drum.

4. The device described in claim 3 wherein a door limitation means and a closable latch are provided for said door.

5. A method of erecting a fence from a coil of fence material utilizing a drum having a closable, latchable door thereon wherein a gap is provided between said door and said drum when said door is closed, the underside of said drum being centrally attached to one end of at least one rotatable support pole, comprising the steps of:

a. placing said coil of fence material into said drum;

b. closing said door;

c. raising said drum;

d. rotating said drum approximately 90 degrees; and e. unrolling said fence material by pulling it through said gap for installation as a fence.

6. A method of erecting a fence from a coil of fence material utilizing a drum having a closable, latchable door thereon wherein a gap is provided between said door and said drum when said door is closed, the underside of said drum being centrally attached to one end of at least one rotatable support pole, comprising the steps of:

a. placing said coil of fence material into said drum such that the leading edge of said coil of fence material passes through said gap;

b. closing and latching said door;

c. raising said drum using said support pole;

d. rotating said drum approximately 90 degrees from horizontal to vertical; and e. unrolling said fence material by pulling it through said gap for installation as a fence.

7. In combination, a transportable lifting machine and a device for erecting chain link fences, said device comprising an elongated drum adapted to receive a coil of fence material, said drum having a closable door thereon through which the leading edge of said coil of fence material may pass when the door is closed, the underside of said drum attached to one end of at least one rotatable support pole, and the opposite end of said pole being removably attached to said transportable machine for lifting and rotating said drum.

* * * * *